US005301638A

United States Patent [19]

Eggers

[11] Patent Number: 5,301,638

[45] Date of Patent: Apr. 12, 1994

[54] ACTUATING ARRANGEMENT FOR A LIFT VALVE

[75] Inventor: Gerhard Eggers, Isenbüttel, Fed. Rep. of Germany

[73] Assignee: Volkswagen AG, Wolfsburg, Fed. Rep. of Germany

[21] Appl. No.: 97,875

[22] Filed: Jul. 27, 1993

[30] Foreign Application Priority Data

Aug. 10, 1992 [DE] Fed. Rep. of Germany ..... 4226357

[51] Int. Cl.[5] ..... F01L 1/12

[52] U.S. Cl. ..... 123/90.16; 123/90.1; 137/624.17; 251/263

[58] Field of Search ..... 123/90.1, 90.15, 90.16; 137/624.13, 624.17; 251/263, 336, 337; 474/138

[56] References Cited

U.S. PATENT DOCUMENTS 4,484,543 11/1984 Maxey ..... 123/90.15
4,576,127 3/1986 Doi et al. ..... 123/90.15
5,052,350 10/1991 King ..... 123/90.16

*Primary Examiner*—E. Rollins Cross
*Assistant Examiner*—Weilun Lo
*Attorney, Agent, or Firm*—Brumbaugh, Graves, Donohue & Raymond

[57] ABSTRACT

An actuating arrangement for a lift valve to be actuated by a cam includes a flexible endless tension member extending in a loop around two rollers and engaging a cam on one side and a valve on the other side.

5 Claims, 1 Drawing Sheet

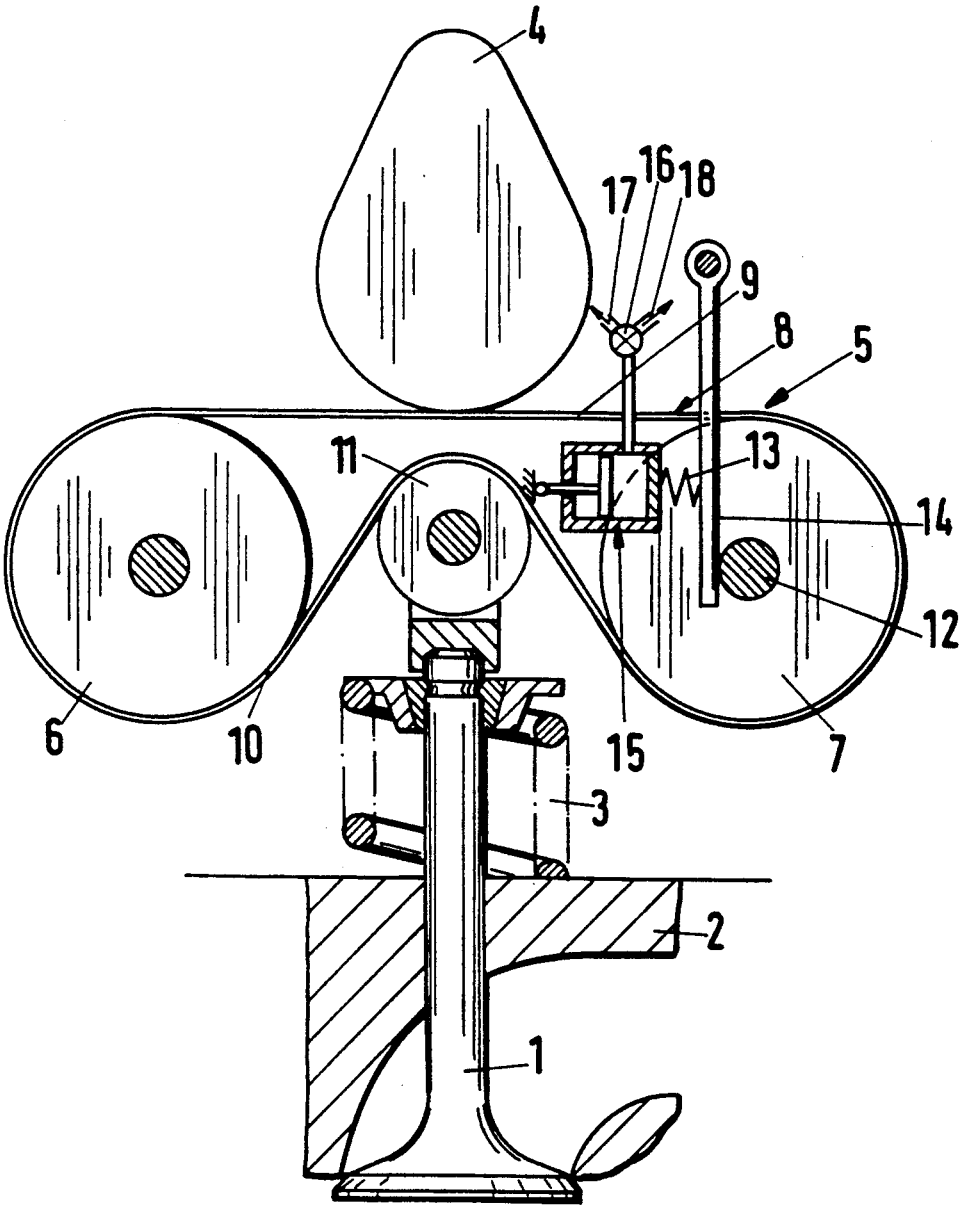
4
17
16
18
9
8
5
11
13
14
12
6
10
15
7
3
2
1

ACTUATING ARRANGEMENT FOR A LIFT VALVE

BACKGROUND OF THE INVENTION

The invention relates to actuating arrangements for lift valves.

In conventional actuating arrangements for lift valves, levers or cranks are used to transmit lifting force from a cam to the valve stem, with the inherent disadvantage of increasing the total mass in motion during operation. Such levers and cranks serve to transmit an actuating force to the valve stem especially in those cases of cams in which, for reasons of design, direct contact between cam and the valve stem, or a tappet, is not possible. Even with such known valve-actuating arrangements, design freedom in the relative disposition of the cam and the valve is limited. In this connection, it should be noted that pivot bearings for the levers or cranks must also be accommodated in the cylinder head of an internal combustion engine.

SUMMARY OF THE INVENTION

Accordingly, it is an object of the present invention to provide an actuating arrangement for a lift valve which overcomes the above-mentioned disadvantages of the prior art.

Another object of the invention is to provide a lift valve-actuating arrangement which provides for a reduced total mass of the oscillating parts and permits greater freedom regarding the relative disposition of the cam and the valve.

These and other objects of the invention are attained by providing a force-transmission arrangement between a cam and a valve which includes an endless flexible tension member having segments which are in force-transmitting relation to the cam and the valve.

Because only one segment of the endless tension member, which may, for example, be in the form of a belt or a chain, participates in the oscillating motion produced by the rotation of the cam, the moving mass in the force-transmission arrangement of the invention is very small. Moreover, since it is necessary to provide only two supports for the endless tension member, and hence only two segments of the tension member extending between supports, there is great freedom regarding the relative arrangement of the cam and the lift valve. Furthermore, the invention provides an opportunity to integrate arrangements for compensating valve play and/or for shutting off the valve, as may be expedient in the lower load and speed ranges for intake valves of an internal combustion engine and which would otherwise be provided separately from the force-transmission arrangement.

BRIEF DESCRIPTION OF THE DRAWING

Further objects and advantages of the invention will be apparent from a reading of the following description in conjunction with the accompanying drawing, which is a cross-sectional view of the region of an intake valve of an internal combustion engine illustrating a representative embodiment of the invention.

DESCRIPTION OF PREFERRED EMBODIMENTS

In the typical embodiment of the invention shown in the drawing, an intake valve 1, which has a conventional construction and therefore is not described in detail, is subjected to a closing force, directed upwardly as seen in the drawing, by a conventional closing spring 3, which engages a surface of the cylinder head 2 of the engine.

To actuate the valve 1, i.e., to cause it to open by moving downwardly as seen in the drawing against the force of the closing spring 3, a cam 4 is rotationally fixed on a conventional camshaft driven by the engine. In this exemplary embodiment, it is assumed that the cam 4 and the stem of the valve 1 face each other directly. With the force-transmission arrangement of the invention provided between the valve 1 and the cam 4 as described hereinafter, however, it is also possible to position the cam to one side of the valve stem.

In accordance with the invention, a force-transmission arrangement 5 comprises an endless flexible tension member 8 which passes in a loop around two spaced support rollers 6 and 7. The tension member may be a cord, a belt or a chain. At least one of the support rollers 6 and 7 is urged away from the other roller so as to act as a tension roller, so that the tension member 8, which has two segments 9 and 10 extending in spaced relation between the support rollers 6 and 7, is kept taut. As a result, a force exerted by the projecting part of the rotating cam 4 on the segment 9 so as to deflect that segment downwardly as seen in the drawing produces an increase in the tension applied to the segment 10 so as to cause that segment to be straightend. In response to such straightening, a pressure roller 11 mounted at the end of the stem of the valve 1 moves downwardly to displace the valve into its open position.

From this explanation of a representative embodiment of the invention, it should be apparent that the transmission arrangement of the invention provides the advantage of great freedom from friction and hence high efficiency.

Since the roller is in the form of a tension roller, the force-transmission arrangement may be designed so that it will also compensate for the play of the valve 1 by its resilient yieldingness. To this end axis 12 under the force of spring 13 exerted by swinglever 14 tends to move to the right. If desired, an additional roller could be provided as a tension roller instead of making one of the support rollers a tension roller. Finally, it is also possible to provide an arrangement for relieving the tension in the tension member 8, for example, by supporting one of the support rollers with a hydraulic suspension so as to cause the valve 1 to remain in its closed position in all rotational positions of the cam 4. Such a valve arrangement can provide improved efficiency, for example, in connection with cylinder shutdown or shut-off of one of several intake valves connected to the same cylinder of an internal combustion engine when operating at low load and/or speed. This is accomplished by the hydraulic cylinder - piston - arrangement 15 which via valve 16 can be emptied (stud 17) or filled (stud 18) with liquid under pressure.

The invention thus provides an actuating arrangement for a lift valve which, with a simple structure, provides numerous advantages, such as freedom from friction, freedom in the relative arrangement of cam and valve, and integration of additional valve actuating-mechanisms.

Although the invention has been described herein with reference to specific embodiments, many modifications and variations therein will readily occur to those skilled in the art. Accordingly, all such variations and modifications are included within the intended scope of the invention.

I claim:

1. An actuating arrangement for a lift valve comprising force-transmitting means including a flexible endless tension member interposed between a cam and a valve and at least two support members supporting the flexible endless tension member so as to provide at least two spaced segments, one of the segments being in force-transmitting relation to a cam and the other segment being in force-transmitting relation to a valve.

2. An actuating arrangement according to claim 1 including a pressure roller interposed between the flexible endless tension member and the valve.

3. An actuating arrangement according to claim 1 wherein at least one of the support members is a tension roller.

4. An actuating arrangement according to claim 3 wherein the tension roller is arranged to compensate for valve play.

5. An actuating arrangement according to claim 3 wherein the tension roller is arranged to shut off the lift valve by relieving the tension in the tension member.

* * * * *